US011367385B2

(12) United States Patent
Rim et al.

(10) Patent No.: US 11,367,385 B2
(45) Date of Patent: Jun. 21, 2022

(54) POWER SAVING BY REORDERING BIT SEQUENCE OF IMAGE DATA

(71) Applicant: Apple Inc., Cupertino, CA (US)

(72) Inventors: Seung Bum Rim, Pleasanton, CA (US); Hopil Bae, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/172,929

(22) Filed: Feb. 10, 2021

(65) Prior Publication Data

US 2021/0272511 A1 Sep. 2, 2021

Related U.S. Application Data

(60) Provisional application No. 62/983,493, filed on Feb. 28, 2020.

(51) Int. Cl.
*G09G 3/32* (2016.01)
*G09G 3/20* (2006.01)

(52) U.S. Cl.
CPC ..... *G09G 3/32* (2013.01); *G09G 3/2007* (2013.01); *G09G 2300/0804* (2013.01); *G09G 2310/027* (2013.01); *G09G 2310/0267* (2013.01); *G09G 2310/08* (2013.01); *G09G 2330/021* (2013.01); *G09G 2330/06* (2013.01)

(58) Field of Classification Search
None
See application file for complete search history.

(56) References Cited

U.S. PATENT DOCUMENTS

| | | | | |
|---|---|---|---|---|
| 9,578,346 | B2 | 2/2017 | Wahadaniah et al. | |
| 10,542,596 | B1 | 1/2020 | Talati et al. | |
| 2006/0139265 | A1 | 6/2006 | Kimura | |
| 2008/0158268 | A1* | 7/2008 | Hui | G09G 3/2022 345/691 |
| 2018/0122340 | A1* | 5/2018 | Kim | G09G 5/393 |
| 2018/0211582 | A1* | 7/2018 | Sakariya | G09G 3/2088 |

* cited by examiner

*Primary Examiner* — Chad M Dicke
(74) *Attorney, Agent, or Firm* — Fletcher Yoder P.C.

(57) ABSTRACT

A display device has a timing controller and a microdriver. The timing controller receives multiple bit sequences of image data for multiple pixels of the display device. The timing controller also reorders the multiple bit sequences based on a significant bit position within the multiple bit sequences. Each of the multiple bit sequences corresponds to a respective individual pixel of the multiple pixels. The microdriver receives the reordered multiple bit sequences and drives the multiple pixels using the reordered plurality of bit sequences.

23 Claims, 7 Drawing Sheets

POWER SAVING BY REORDERING BIT SEQUENCE OF IMAGE DATA

CROSS-REFERENCE TO RELATED APPLICATIONS

This application claims priority to and the benefit of U.S. Provisional Application No. 62/983,493, filed Feb. 28, 2020, and entitled, "POWER SAVING BY REORDERING BIT SEQUENCE OF IMAGE DATA," which is incorporated herein by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to systems and devices for reordering a bit sequence representing a gray level for driving pixels of a display.

In particular, reordering the bit sequence may result in less value variance in the bit sequence than without reordering. The number of value variances may correspond to a number of toggles of a respective row driver used to drive the pixels, and each toggle may be associated with a level of power consumption. As such, reducing the number of toggles by reordering the bit sequence may reduce power consumption. In some instances, reducing the number of toggles of the respective row driver may also reduce electromagnetic interference within the display.

As previously mentioned, values of the reordered multiple bit sequences may be rearranged based on the significant bit position. For example, bits may be reordered based on a most significant bit to a least significant bit for each of the multiple bit sequences. That is, rather than sending a bit sequence pixel-by-pixel (e.g., for a first pixel, then a second pixel, and so forth), the bit sequence is sent based on a bit position (e.g., for a first bit position (e.g., a most significant bit), a second bit position of a second most significant bit, and so forth, until a last bit position (e.g., least significant bit)).

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
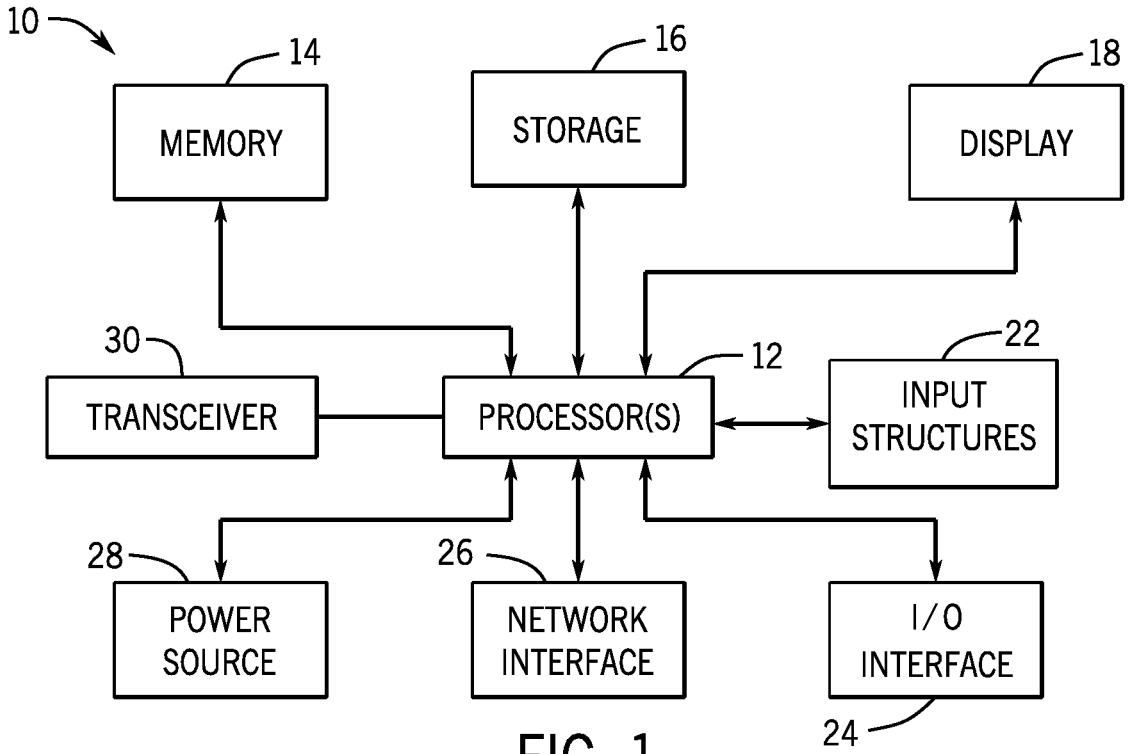
FIG. 1 is a block diagram of an electronic device, according to an embodiment of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure relates generally to electronic displays and, more particularly, to an order of bit sequence of image data stored in binary format that reduces power consumption. Some electronic displays, such as light emitting diode (LED) displays, organic light emitting diode (OLED), and/or micro light emitting diode (μ-LED) displays, may include row drivers and column drivers that provide driving signals for pixels, referred to as display pixels or micropixels, of the electronic display. In μ-LED displays, the row drivers or column drivers may send image data signals to a microdriver, which is a circuit that drives one or more display pixels (e.g., micropixels) connected to it based on the image data signals. The display pixels may include any pixels that are driven by the microdriver. A pixel may be understood as a unit of the display that includes a single color (e.g., red, green, blue, or white) or the pixel may be a unit of subpixels of single individual colors that may display any color that the display is capable of displaying using combinations of the individual colors.

In LED, OLED, and liquid crystal display (LCD) panels, a column driver may send the driving signal to the display pixel to display the particular color. However, in μ-LED display panels, the column driver may send image data to the microdriver, which may then send a corresponding driving signal to the display pixels to display the particular color. Specifically, the image data for a target display pixel may include a gray level (e.g., brightness level) value that is represented and stored in a binary format. The gray level value may include a range of values from 0 to 255 in a binary format (e.g., bit value or a byte), corresponding to an amount of luminance to facilitate in displaying an image on the electronic display. A gray level value of 0 may refer to no luminance while a gray level value of 255 may correspond to a highest possible luminance. Values in between may make up different shades of gray.

The gray level value for each display pixel connected to the microdriver may be sent to the microdriver in a sequential order—a pixel-by-pixel sequence. Thus, each of the bits may be processed sequentially for each display pixel. The row driver that is driving the microdriver may be toggled each time the bit value changes, such as from a 0 to 1 or 1 to 0 when processing the bits. Each toggle may consume power, resulting in less power available for other components in an electronic device with the display. Thus, a number of value variances within a bit sequences representing gray values for display pixels may correspond to a number of toggles of a respective row driver used to drive the display pixels. Each toggle may be associated with a level of power consumption. As such, reducing the number of toggles may reduce power consumption. Often, a microdriver drives a set of the display pixels that may be located in close proximity to each other on the display. Since these pixels are closely located on the display, the image data that they display may also be similar. For example, an image with a large region of sky has a large region of pixels with similar gray levels that, when applied to red, green, and blue pixels, produce the color of the sky. In this example, the red pixels may have similar values, the green pixels may have similar values, and the blue pixels may have similar values. This is not always the case, of course, but regions of similar colors occur often enough in image content that the systems and methods of this disclosure may provide a significant power savings over time.

In sum, in many situations, a set of pixels associated with a particular microdriver may emit similar gray levels to generate a portion of the image to be displayed on the display. In particular, pixels near each other in the portion of the image tend to have similar gray levels to depict similar colors making up the image, resulting in the more significant bits (e.g., most significant bit, second most significant bit, third most significant bit, etc.) for each of these display pixels to be the same value. When the set of display pixels have very similar gray levels, the less significant bits (e.g., each bit except the least significant bit) may also be the same. Moreover, if the display pixels have the same gray levels, the least significant bit may also be the same. As such, the value variance between the bit significance position in the bit sequences for the set of display pixels may be fewer than the value variance within the bit sequences for each of the individual pixels of the set of display pixels. Accordingly, reordering the bit sequences based on location of display pixels on the display or position within the bit sequences (e.g., first bit position (e.g., most significant bit), a second bit position, and so forth until a last bit position (e.g., least significant bit)) rather than by pixel-by-pixel sequence (e.g., for a first subpixel, then a second subpixel, and so forth) may result in relatively fewer toggles.

With the foregoing in mind, there are many suitable communication devices that may benefit from a reordered bit sequence of gray level values for a set of display pixels described herein. Turning first to FIG. 1, an electronic device 10 according to an embodiment of the present disclosure may include, among other things, one or more processor(s) 12, memory 14, nonvolatile storage 16, a display 18, input structures 22, an input/output (I/O) interface 24, a network interface 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
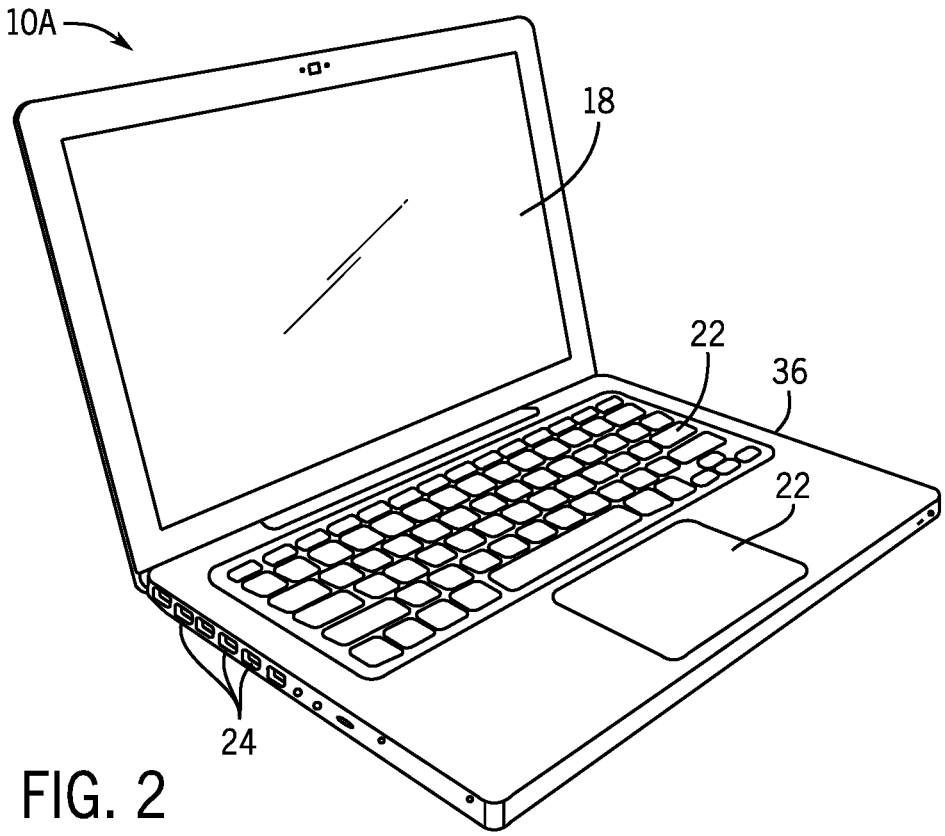
FIG. 2 is a perspective view of a notebook computer representing an embodiment of the electronic device of FIG. 1.
Figure 4:
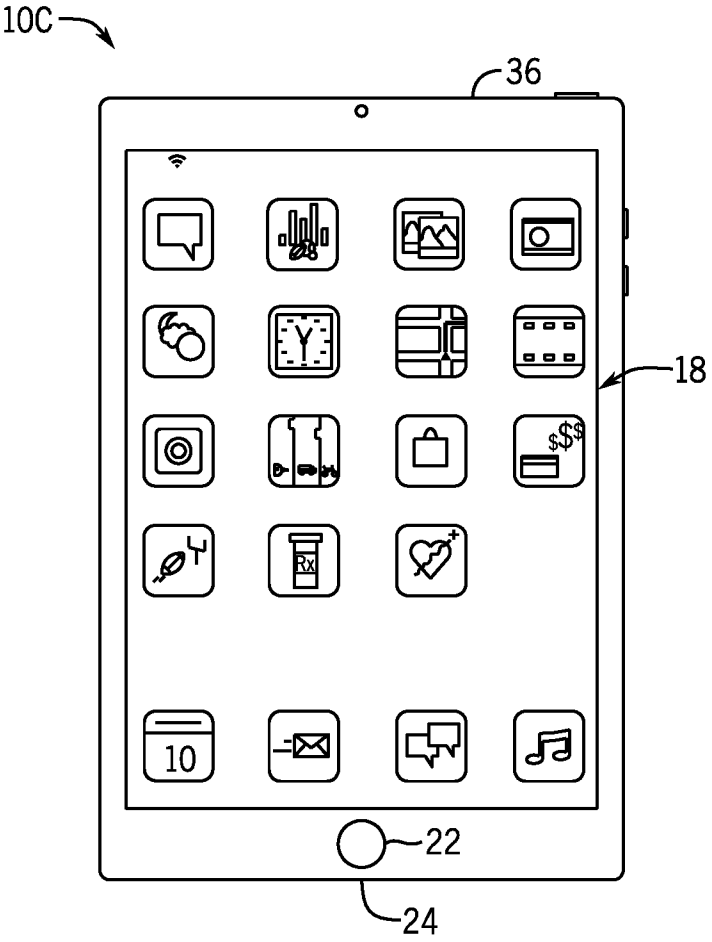
FIG. 4 is a front view of another handheld device representing another embodiment of the electronic device of FIG. 1.
Figure 3:
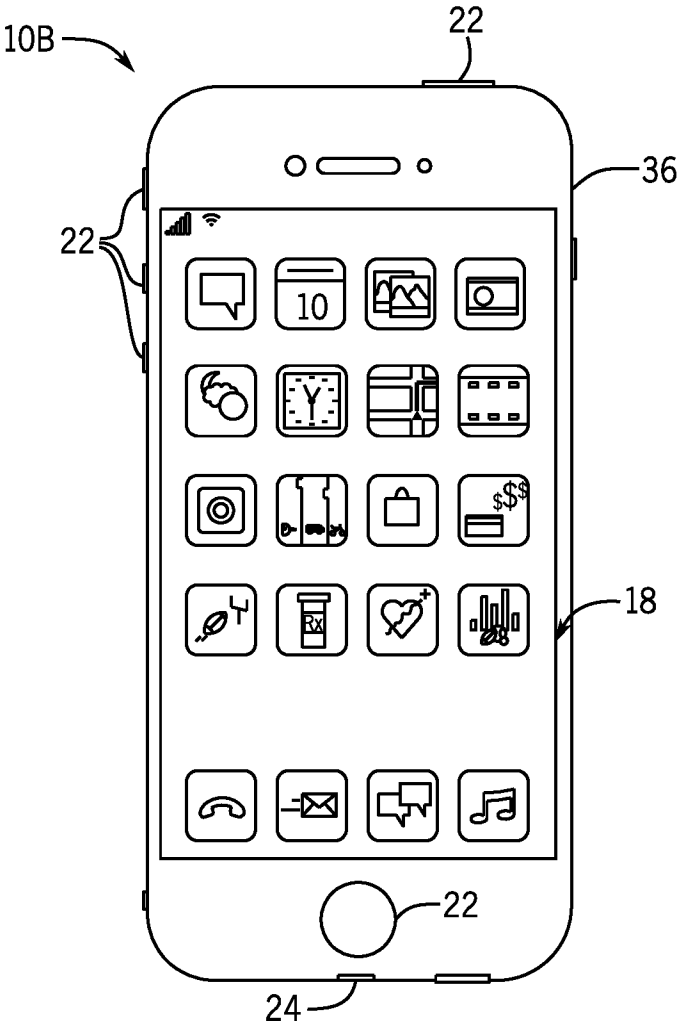
FIG. 3 is a front view of a handheld device representing another embodiment of the electronic device of FIG. 1.
Figure 5:
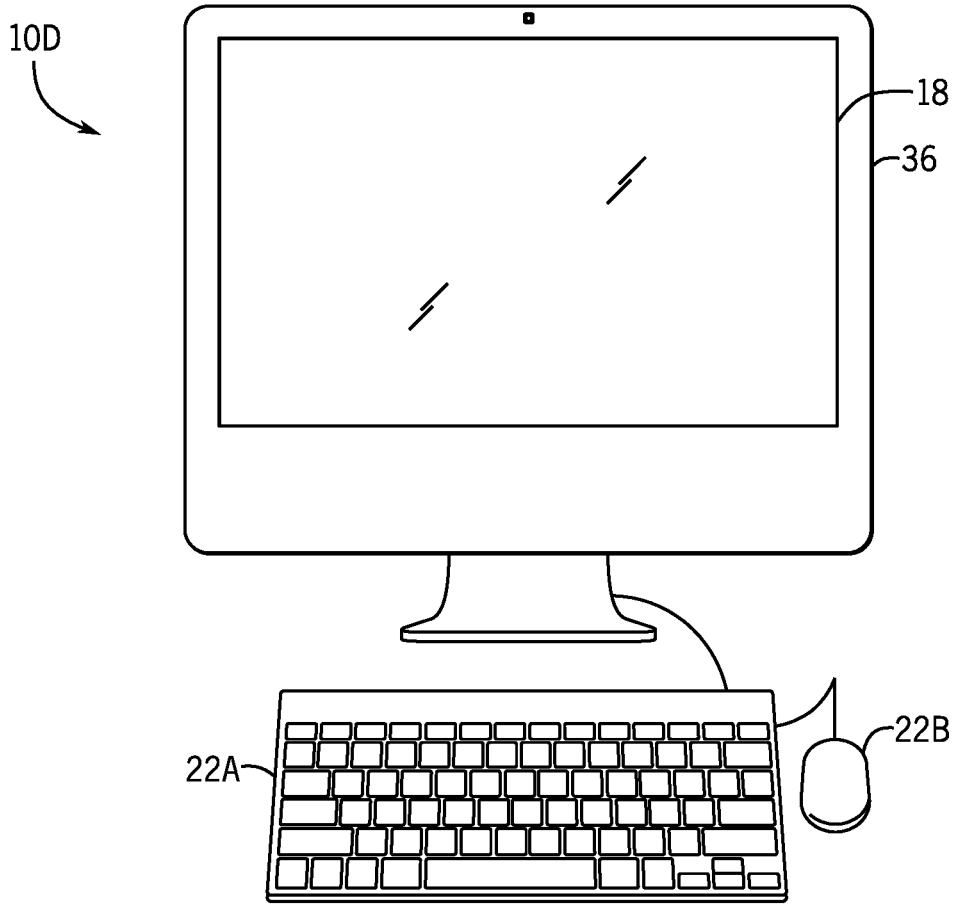
FIG. 5 is a front view of a desktop computer representing another embodiment of the electronic device of FIG. 1.
Figure 6:
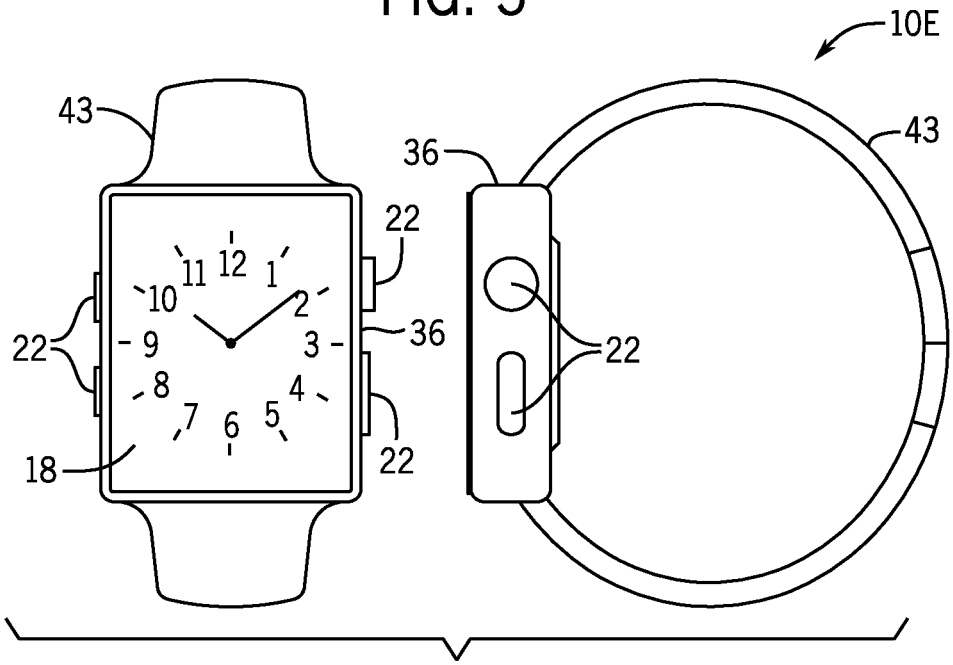
FIG. 6 is a front view and side view of a wearable electronic device representing another embodiment of the electronic device of FIG. 1.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and other related items in FIG. 1 may be embodied wholly or in part as software, hardware, or any combination thereof. Furthermore, the processor(s) 12 and other related items in FIG. 1 may be a single contained processing module or may be incorporated wholly or partially within any of the other elements within the electronic device 10.

In the electronic device 10 of FIG. 1, the processor(s) 12 may be operably coupled with a memory 14 and a nonvolatile storage 16 to perform various algorithms. Such programs or instructions executed by the processor(s) 12 may be stored in any suitable article of manufacture that includes one or more tangible, computer-readable media. The tangible, computer-readable media may include the memory 14 and/or the nonvolatile storage 16, individually or collectively, to store the instructions or routines. The memory 14 and the nonvolatile storage 16 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 12 to enable the electronic device 10 to provide various functionalities.

For example, a bit sequence, such as a reordered bit sequence based on a location of display pixels or bit positions within individual bit sequences for the display pixels, may be saved in the memory 14 and/or nonvolatile storage 16. An n-bit (e.g., one or more bits depth) gray level value for each display pixel connected to the microdriver may be sent for each micropixel in a sequential order, referred to as a pixel-by-pixel sequence herein. Each time the bit value changes within the sequence, the column driver and/or row driver may be toggled and the electronic device 10 may consume power with each toggle. The gray level value may include a range of values from 0 to 255 in the 8-bit binary format. However, the display pixels driven by the microdriver may be associated with a region of the display 18, such that the display pixels within the region generate the same or approximately the same portion of an image. Thus, the gray level value for these display pixels may often be the same or approximately the same. In such instances, the most significant bit for these display pixels may be the same (e.g., binary 1). As such, reordering the n-bit gray level values for the display pixels based on bit position within the binary value, such as by the most significant bits of the display pixels to the least significant of the display pixels, may reduce the number of toggles since the bits may stay the same for a larger portion of the reordered bit sequence. Thus, the n-bit gray level value of the display pixels driven by the microdriver may be reordered based on location of the display pixels on the display 18 and/or location or position of the bit within the bit sequence, referred to as a column-by-column sequence or a location-based sequence herein.

In certain embodiments, the display 18 may be a light-emitting diode (LED) display (e.g., a micro light emitting diode (μ-LED) display or an organic light-emitting diode (OLED) display), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more liquid crystal displays (LCDs), or some combination of LCD, LED, and/or OLED panels.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, one or more interfaces for a personal area network (PAN), such as a Bluetooth network, for a local area network (LAN) or wireless local area network (WLAN), such as an 802.11x Wi-Fi network, and/or for a wide area network (WAN), such as a 3rd generation (3G) cellular network, universal mobile telecommunication system (UMTS), 4th generation (4G) cellular network, long term evolution (LTE) cellular network, long term evolution license assisted access (LTE-LAA) cellular network, 5th generation (5G) cellular network, and/or 5G New Radio (5G NR) cellular network. In particular, the network interface 26 may include, for example, one or more interfaces for using a Release-15 cellular communication standard of the 5G specifications that include the millimeter wave (mmWave) frequency range (e.g., 24.25-300 GHz). The electronic device 10, which includes a transmitter and a receiver (e.g., transceiver), may allow communication over the aforementioned networks (e.g., 5G, Wi-Fi, LTE-LAA, and so forth).

The network interface 26 may also include one or more interfaces, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra-Wideband (UWB), alternating current (AC) power lines, and so forth. As further illustrated, the electronic device 10 may include a power source 28. The power source 28 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, a display 18, input structures 22, and ports of an I/O interface 24. In one embodiment, the input structures 22 (such as a keyboard and/or touchpad) may be used to interact with the computer 10A, such as to start, control, or operate a graphical user interface (GUI) or applications running on computer 10A. For example, a keyboard and/or touchpad may allow a user to navigate a user interface or application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the display 18. The I/O interfaces 24 may open through the enclosure 36 and may include, for example, an I/O port for a hardwired connection for charging and/or content manipulation using a standard connector and protocol, such as the Lightning connector provided by Apple Inc., a universal serial bus (USB), or other similar connector and protocol.

User input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone that may obtain a user's voice for various voice-related features, and a speaker that may enable audio playback and/or certain phone capabilities. The input structures 22 may also include a headphone input that may provide a connection to external speakers and/or headphones.

FIG. 4 depicts a front view of another handheld device 10C, which represents another embodiment of the electronic device 10. The handheld device 10C may represent, for example, a tablet computer, or one of various portable computing devices. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the display 18. In certain embodiments, a user of the computer 10D may interact with the computer 10D using various peripheral input structures 22, such as the keyboard 22A or mouse 22B, which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple Inc. However, in other embodiments, the wearable electronic device 10E may include any wearable electronic device such as, for example, a wearable exercise monitoring device (e.g., pedometer, accelerometer, heart rate monitor), or other device by another manufacturer. The display 18 of the wearable electronic device 10E may include a touch screen display 18 (e.g., μ-LED display, OLED display, active-matrix organic light emitting diode (AMOLED) display, and so forth), as well as input structures 22, which may allow users to interact with a user interface of the wearable electronic device 10E.

Figure 7:
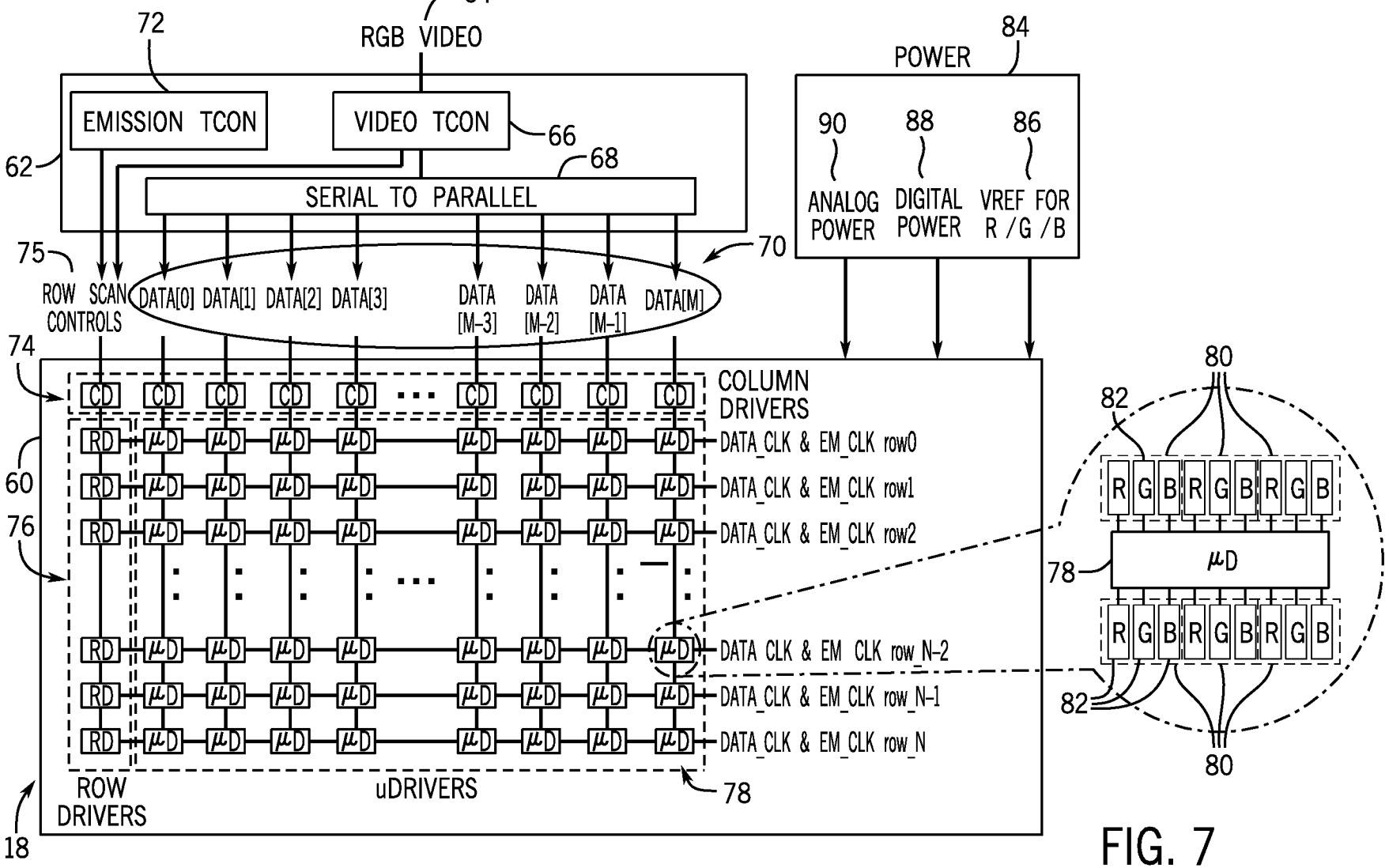
FIG. 7 is a block diagram of a μ-LED display with microdrivers to drive display pixels, in accordance with an embodiment of the present disclosure.

With the foregoing in mind, FIG. 7 is block diagram of the display 18 as a μ-LED display, according to embodiments of the present disclosure. In the depicted embodiment, the display 18 includes a RGB display panel 60 with microdrivers 78 that drive display pixels (e.g., micropixels). The display pixels may include one or more pixels 80 and/or one or more red, green, and/or blue μ-LED subpixels 82. By way of example, the microdriver 78 may drive four subpixels over one data line. A bit sequence described herein may refer to a bit sequence to drive the one or more pixels 80 and/or the one or more red, green, or blue subpixels 82 connected to or driven by a particular microdriver 78. Although the following descriptions discuss the display pixels driven by the microdrivers 78 as subpixels 82, the systems and methods described herein may be applied to one or more pixels 80 and/or one or more subpixels 82. In some embodiments, one microdrivers 78 may drive at least one red, green, and/or blue subpixels 82. In other embodiments, the microdriver 78 may drive one color subpixels 82, such as red subpixels 82. In such embodiments, the bit sequence described herein may refer to the bit sequences to drive the red subpixels 82 connected to the particular microdriver 78. As shown, the display 18 includes a support circuitry 62 that receives RGB-format video image data 64 and a power supply 84 that drives the microdrivers 78. It should be appreciated, however, that the display 18 may include alternative display types and thus, the support circuitry 62 may receive image data 64 in a respective alternative image format.

As shown, the support circuitry 62 may include a video timing controller 66 (video TCON), an emission timing controller 72 (emission TCON), and a serial-to-parallel circuit 68. The video TCON 66 may receive the image data 64 in a serial signal to determine a data clock signal (DATA_CLK) that controls distribution of the image data 64 in the display 18. The video TCON 66 may pass the image data 64 to the serial-to-parallel circuitry 68 that may deserialize the image data 64 signal into several parallel image pixel data 70 signals to send to the microdrivers 78. Specifically, the serial-to-parallel circuitry 68 may collect the image data 64 into the pixel data 70, such as pixel data 70 for a group of subpixels 82 in a particular region of the display 18 (e.g., for a portion of an image to be displayed on the display 18). The pixel data 70 may be passed on to specific columns among a total of M respective columns in the display panel 60. As such, the pixel data 70 is labeled DATA[0], DATA[1], DATA[2], DATA[3] . . . DATA[M−3], DATA[M−2], DATA[M−1], and DATA[M].

Generally, the pixel data 70 may include image data 64 corresponding to subpixels 82 in the first column, second column, third column, fourth column . . . fourth-to-last column, third-to-last column, second-to-last column, and last column, respectively. For example, the pixel data 70 may include a binary format of a respective gray level of the image to be emitted by the subpixels 82. The serial-to-parallel circuitry 68 may send the pixel data 70 to more or fewer columns depending on the number of columns that make up the display panel 60. In some embodiments, as previously discussed, the pixel data 70 may include image data 64 for a particular set of subpixels 82 located in a particular region of the display 18 that are driven by a particular microdriver 78. In such embodiments, the serial-to-parallel circuitry 68 may send this pixel data 70 to the particular microdriver 78 driving the subpixels 82 of the region. As will be discussed in detail with respect to FIG. 10, the pixel data 70 including image data 64 for the subpixels 82 for a particular region on the display 18 may be reordered based on location or bit positions within the respective bit sequences. Specifically, the pixel data 70 may include an indication of the manner in which the pixel data 70 is to be processed for each of the subpixels 82. That is, the indication may flag the microdrivers 78 to process the pixel data 70 in the column-by-column sequence rather than the pixel-by-pixel sequence.

As noted above, the video TCON 66 may generate the data clock signal (DATA_CLK) that controls distribution of the image data 64 in the display 18. The emission TCON 72 may generate an emission clock signal (EM_CLK). The emission clock signal may control when the subpixels 82 emit light during a frame of image data or during sub-frames of the frame of image data. Collectively, the data clock signal and the emission clock signal may be referred to as row scan control signals 75.

As shown, the display panel 60 includes column drivers 74, row drivers 76, and the microdrivers 78. Each microdriver 78 may drive a number of pixels 80 and/or its subpixels 82 over data lines. Each pixel 80 may include at least one red μ-LED, at least one green μ-LED, and at least one blue μ-LED to represent the image data 64 in RGB format. In other embodiments, the pixel 80 may include four or more individual color or same color μ-LEDs. Although the depicted microdrivers 78 drive six pixels 80 having three subpixels 82 each, which represents a particular embodiment, the microdrivers 78 may drive more or fewer pixels 80 and/or subpixels 82. That is, the microdrivers 78 may each drive 1, 2, 3, 6, 12, 18, and so forth, subpixels 82 via respective data lines. By way of example, the microdrivers 78 may use one data line to drive four subpixels 82, such that the bit sequence sent over the one data line causes the four subpixels 82 to emit at a gray level corresponding to the bit sequence. Thus, to drive four pixels 80 that include four subpixels 82 each, the microdriver 78 may use four data lines to provide the respective pixel data 70 to the sixteen subpixels 82. In some instances, and as will be discussed with respect to FIG. 11, the multiple bit sequences for the respective subpixels 82 may be reordered. The bits of the multiple bit sequences of the same significance (e.g., most significant bit, second most significant bit, and so forth) may be provided over the same data line of the multiple data lines.

The power supply 84 may provide a reference voltage ($V_{ref}$) 86, a digital power signal 88, and/or an analog power signal 90. The reference voltage 86 may drive the subpixels 82. In some cases, the power supply 84 may provide more than one reference voltages 86 to drive the subpixels 82. Namely, the microdrivers 78 may drive subpixels 82 of different colors (e.g., red, blue, and/or green) using the reference voltages 86. As such, the power supply 84 may provide more than one reference voltage 86 for each color. The digital power signal 88 and/or an analog power signal 90 may provide power in a digital or analog format, respectively, to components of the display 18. Additionally or alternatively to the power supply 84, other circuitry on the display panel 60 may step the reference voltage 86 up or down to obtain different reference voltages to drive the different colors of subpixels 82.

Moreover, to allow the microdrivers 78 to drive the subpixels 82 of the pixels 80, the column drivers 74 and the row drivers 76 may operate together. Each column driver 74 of a column may drive the respective pixel data 70 for the respective column in a digital form. Meanwhile, each row driver 76 of a row may provide the data clock signal (DATA_CLK) and the emission clock signal (EM_CLK) (e.g., row scan control signals 75) at an appropriate level to activate the row of microdrivers 78 driven by the row driver 76. A row of microdrivers 78 may be activated when a row driver 76 controlling the respective row sends the data clock signal (DATA_CLK) to the microdrivers 78. This may cause the activated microdrivers 78 of the row to receive and store the digital pixel data 70 that is driven by the column drivers 74. The microdrivers 78 of the row may subsequently drive the subpixels 82 based on the stored digital pixel data 70 from the column drivers 74 based on the emission clock signal (EM_CLK).

Figure 8:
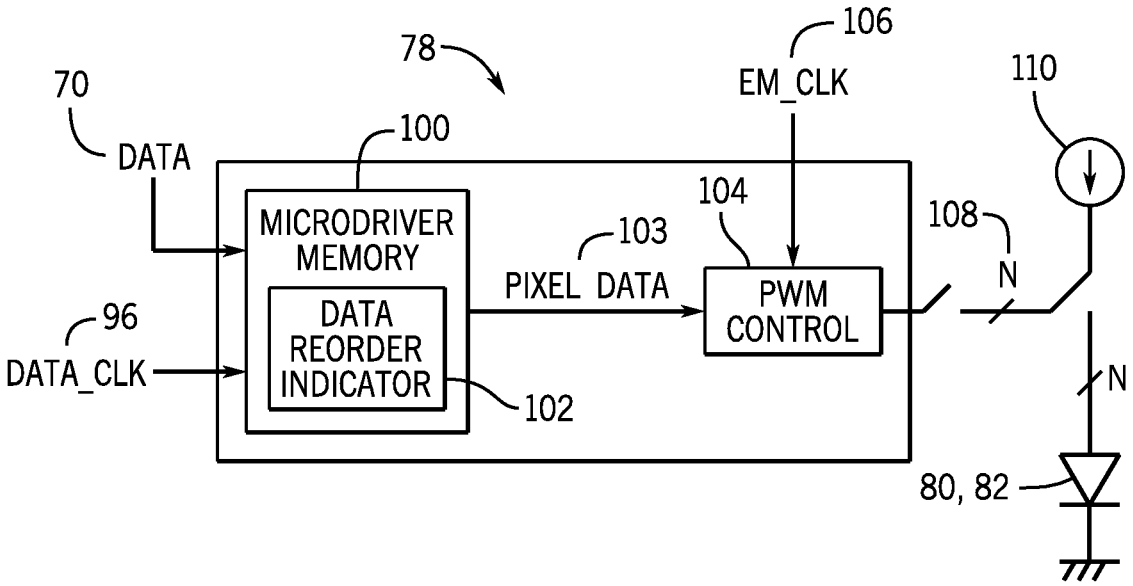
FIG. 8 is a block diagram of a microdriver of the μ-LED display of FIG. 7, according to embodiments of the present disclosure.

As previously discussed, the microdrivers 78 that drive the subpixels 82 may process the pixel data 70 in a pixel-by-pixel sequence and/or in a reordered sequence based on location of the pixels 80 on the display 18 or position of bits within respective bit sequences. To illustrate, FIG. 8 is a block diagram of a microdriver 78, according to embodiments of the present disclosure. As shown, the microdriver 78 may include a microdriver memory 100, a pulse width modulation (PWM) controller 104, a microdriver power source 110, and a pixel 80, which may include subpixels 82. As previously mentioned, although the following descriptions discuss the display pixels driven by the microdrivers 78 as subpixels 82, the systems and methods described herein may be applied to one or more pixels 80 and/or one or more subpixels 82.

As shown, the microdriver memory 100 may receive the pixel data 70, such as by the serial-to-parallel circuitry 68, using the techniques described in FIG. 7. The pixel data 70 may include as a bit sequence corresponding to a gray level for the pixels 80 and/or subpixels 82 driven by the microdriver 78. The microdriver memory 100 may receive the data clock signal 96 (DATA_CLK), such as by a respective row driver 76 coupled to the microdriver 78. The data clock signal 96 (DATA_CLK) may distribute the pixel data 70 to the microdriver 78 to be distributed to the subpixels 82. As shown, the microdriver 78 may drive an N (e.g., one or more) number of subpixels 82. In some embodiments, the subpixels 82 may include a set of subpixels 82 of pixels 80 that are similarly located on a region of the display 18. By way of example, the microdriver 78 may drive multiple pixels 80 that are located within close proximity to each other on the display 18 to depict a portion of an image to be displayed. Thus, the subpixels 82 of these pixels 80 may often display similar colors or gray levels (e.g., 250, 251, 252, etc.) based on a corresponding portion of the image. As will be discussed in detail with respect to FIG. 9, the similar gray levels may result in a gradual change in color and/or brightness amongst the subpixels 82. Since the subpixels 82 may result in a gradual change in color and/or brightness, a most significant bit of the corresponding n-bit gray level values representing the color and/or brightness may be the same (e.g., binary 1). Moreover, the next few significant bits (e.g., second and third most significant bit) may also include the same number (e.g., binary 1). In such instances, the n-bit sequences of gray level values for each of the subpixels 82 may be reordered so that the bits for all the subpixels 82 in the region driven by the microdriver 78 may be ordered by most significant bit to the least significant bit for the subpixels 82. As will be discussed in detail with respect to FIG. 10, reordering the bit sequence may result in fewer toggles than when the microdriver 78 processes the most significant bit to the least significant bit for one subpixel 82, repeats it for the next subpixel 82, and so forth.

The microdriver memory 100 may include one or more pixel data buffers that includes sufficient storage to hold the pixel data 70. For instance, the microdriver 78 may include enough pixel data buffers to store the pixel data 70 for four subpixels 82 at a time interval (e.g., for an 8-bit sequence of pixel data 70, this may be 32 bits of storage for each of the subpixels 82). It should be appreciated, however, that the microdriver memory 100 may include more or fewer pixel data buffers, depending on the data rate of the pixel data 70 and/or the pixel data 70 for the number of subpixels 82 driven by the microdriver 78. Thus, in some embodiments, the pixel data buffer may include as few buffers as to hold the pixel data 70 for one pixel 80 and its corresponding subpixels 82.

In some embodiments, such as when the microdriver 78 drives multiple subpixels 82 of pixels 80 that are located in the shared region of the display 18, the microdriver memory 100 may include a data reorder indicator 102. The shared region on the display 18 may include at least a portion of the same one or more columns and/or at least a portion of the same one or more rows. The data reorder indicator 102 may include an indication for the manner in which the pixel data 70 is to be sent to the subpixels 82. In particular, the pixel data 70 may be reordered before the microdriver memory 100 receives it and/or as the microdriver memory 100 stores it and subsequently reads it to the subpixels 82. By way of example, the data reorder indicator 102 may include a particular bit and/or a flag to indicate the manner in which the pixel data 70 should be stored in the microdriver memory 100 and/or read to the subpixels 82. That is, if the pixel data 70 includes the particular bit or flag (e.g., in the pixel data 70 bitstream), then the microdriver memory 100 may store the pixel data 70 in the reordered format or reorder the pixel data 70 prior to sending it to the subpixels 82. In some embodiments, the support circuitry 62 may reorder and/or send the reordered bit sequence of pixel data 70 prior to sending it to the microdriver 78 to drive the subpixels 82. As will be described in detail in FIG. 11, the support circuitry 62 may receive the n-bit sequence for a set of pixels and then reorder the bit sequence based on a bit position prior to sending it to the microdriver 78. Additionally or alternatively, the support circuitry 62 may initially send a predefined number of bits (e.g., two n-bit sequences) when sending the pixel data 70 to the microdriver 78 to determine an operation mode to send the remaining bit sequences. Determining the operation mode may be based on one that results in reduced power consumption and/or reduced interference. As will be described in detail in FIG. 12, the support circuitry 62 may determine the mode, such as a pixel-by-pixel mode (e.g., a first mode) and/or a reorder mode (e.g., a second mode), based on the bit sequences of the predefined number of bits. Furthermore, the support circuitry 62 may communicate the determined mode to the microdriver 78 to facilitate reading the bit sequences for the pixel data 70.

In some embodiments, the pixel data 70 may be reordered based on content. Specifically, the reordering bit or flag may be set or included when the pixel data 70 is low frequency. Low frequency may refer to the n-bit sequences corresponding to the respective gray level values for each of the subpixels 82 (e.g., the n-bit sequence of a first subpixel 82, a second subpixel 82, a third subpixel 82, and so forth) in the region to not significantly vary (e.g., the most significant bits of the n-bit gray level values for each of the subpixels 82 are the same). On the other hand, high frequency may refer to the pixel data 70 to significantly vary (e.g., the most significant bits of the n-bit values are not the same). In some embodiments, the reordering bit or flag may be set based on a predefined threshold (e.g., a level of frequency). That is, the bits may be reordered when the n-bit sequence for the subpixels 82 vary within the threshold (e.g., do not significantly vary).

The microdriver memory 100 may take any suitable logical structure based on the order that the column driver 74 provides the pixel data 70. For example, the pixel data buffers may include a first-in-first-out (FIFO) logical structure or a last-in-first-out (LIFO) structure to read the pixel data 70 pixel-by-pixel. In some embodiments, the pixel data buffers may include a reordering structure to read the bits of the pixel data 70 column-by-column or based on the region of the display 18 driven by the microdriver 78.

The microdriver memory 100 may output enough of the stored pixel data 70 to output a digital pixel data signal 103 that may represent a desired gray level for the particular subpixels 82 to be driven by the microdriver 78. In particular, the digital pixel data signal 103 may include the pixel data 70 in the reordered sequence and/or in the pixel-by-pixel sequence (e.g., in its original format). In some embodiments, the pulse width modulation control 104 may include a counter that may receive the emission clock signal 106 (EM_CLK) as an input from one or more row drivers 76. The pulse width modulation control 104 may use the emission clock signal 106 (EM_CLK) and the digital pixel data signal 103 to drive the subpixels 82 to emit light at their respective gray level. That is, the pulse width modulation controller 104 may switch on and off each subpixel 82 based on the digital pixel data signal 103 associated with that subpixel 82 over any suitable number, N (e.g., one or more), of signal lines 108. The amount of time the subpixels 82 are on is based on the gray level that the subpixels 82 display.

In one example, the pulse width modulation control 104 may use a counter to count edges (only rising, only falling, or both rising and falling edges) of the emission clock signal 106 (EM_CLK), which may take any suitable form. For example, the emission clock signal 106 (EM_CLK) may include pulses of many different widths that may be added to represent different gray levels. In some embodiments, the pulse width modulation controller 104 may also include a comparator. The digital pixel data signal 103 and the emission clock signal 106 (EM_CLK) may enter the comparator of the pulse width modulation controller 104 to output an emission control signal in an "on" state when the digital counter signal does not exceed the digital pixel data signal 103, and an "off" state otherwise. The emission control signal may be routed over the signal lines 108 to cause the subpixels 82 to be driven on or off, which causes light to emit from the selected subpixels 82 to be on or off. Specifically, microdriver power source 110 may provide a current and/or a respective voltage to drive the subpixels 82 for the particular time period based on the emission control signal. The longer the selected subpixels 82 are driven "on" by the emission control signal, the greater the amount of light may be emitted from the respective subpixels 82.

Figure 9:
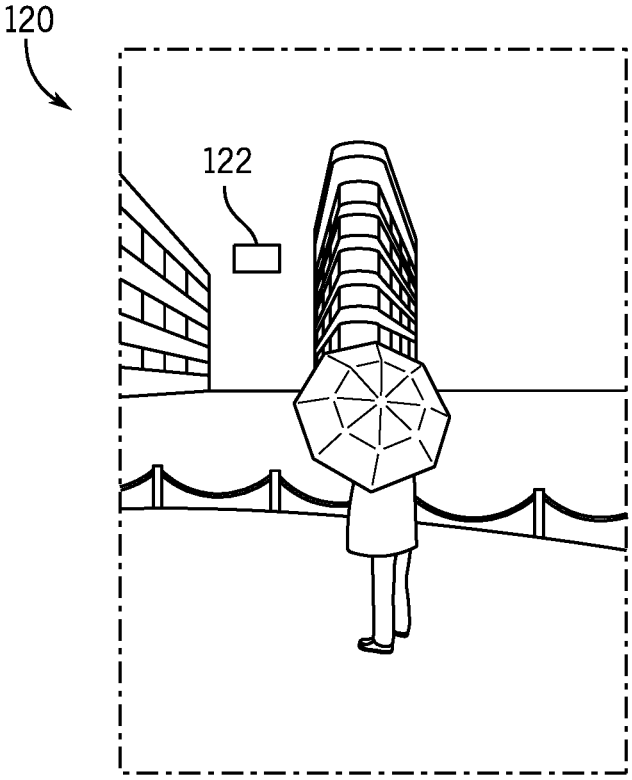
FIG. 9 is a block diagram of an image indicating a set of gray levels corresponding to a respective set of display pixels, according to embodiments of the present disclosure.

To illustrate the reordering of the bit sequence based on image content, FIG. 9 depicts image 120 indicating a set of gray levels corresponding to a respective set of display pixels. As shown, the image 120 to be displayed on the display 18 (e.g., display panel 60 of FIG. 7) may include different gray levels throughout the image. While some higher-frequency portions of the image may have a variety of different gray levels between pixels that are close to one another, lower-frequency portions of the image may have groups of nearby pixels with similar gray levels.

In some embodiments, such as the depicted image 120, a continuous portion (e.g., a region) of the image 120 that includes the same or approximately the same luminance may include correspondingly the same or approximately the same gray level values. By way of example, a low-frequency luminance region 122 may include multiple pixels 80 and/or subpixels 82 that emit the same or approximately the same gray level values. These pixels 80 and/or subpixels 82 may benefit from a reordered bit sequence. Although the following descriptions discuss reordering the bit sequences for a group of pixels 80 and/or subpixels 82 in the low-frequency luminance region 122, which describes a particular embodiment, the systems and methods of reordering bit sequences may be used with any arrangement of pixels 80 and/or subpixels 82 driven by the microdriver 78. By way of example, reordered bit sequences for a group of pixels 80 and/or subpixels 82 driven by the microdriver 78 may include a row arrangement (e.g., one or more rows), a column arrangement (e.g., one or more columns), a block arrangement (as depicted) (e.g., one or more rows and columns), and/or a non-continuous portion arrangement. Thus, the microdriver 78 may drive the group of pixels 80 and/or subpixels 82 for any of these arrangements using the reordered bit sequences, as described herein.

Figure 10:
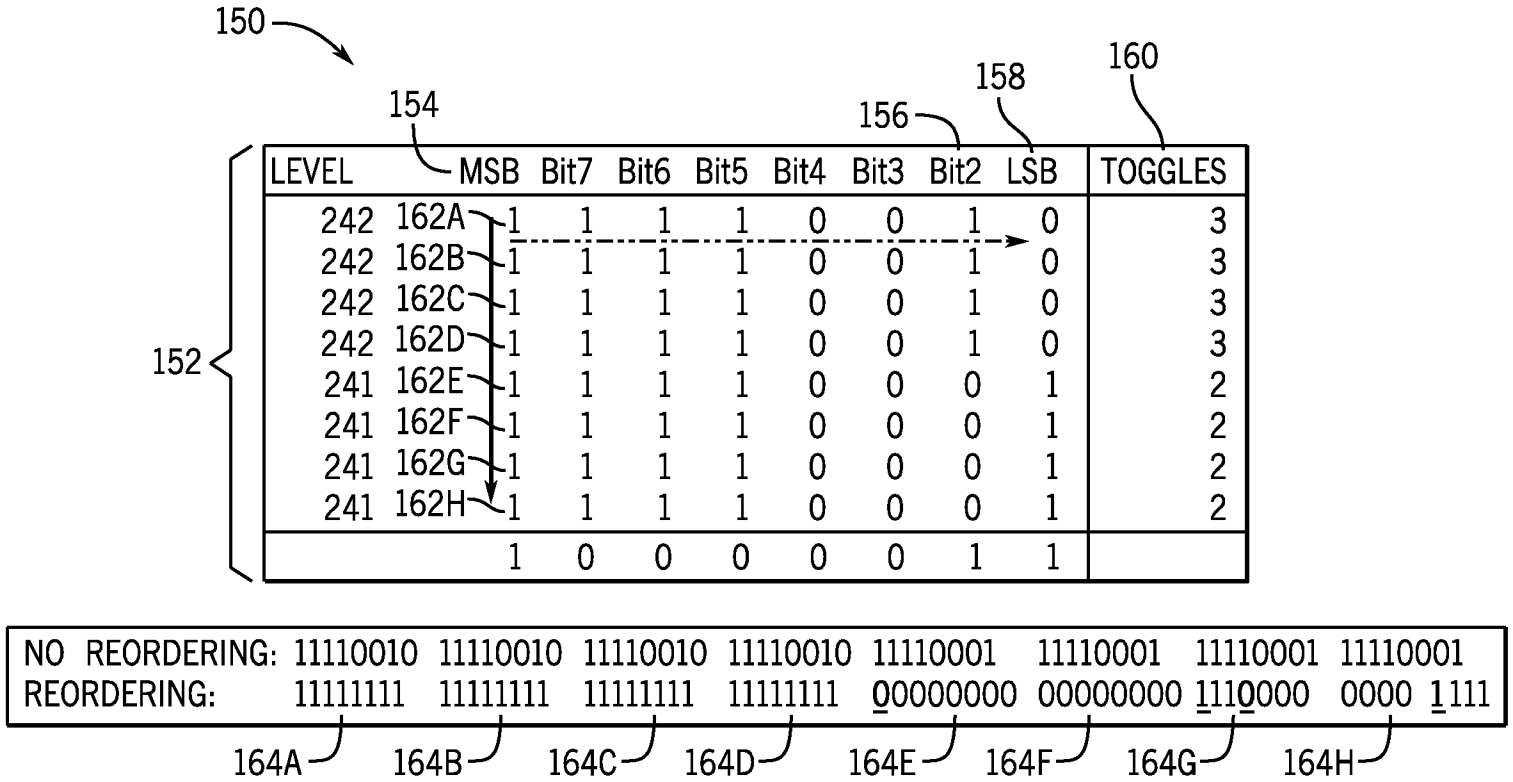
FIG. 10 is a block diagram of a bit sequence representing the gray levels of FIG. 9, according to embodiments of the present disclosure.

To illustrate, FIG. 10 is a block diagram of a bit sequence 150 corresponding to gray levels 152 of a particular color of subpixels 82 of the low-frequency luminance region 122. As previously mentioned, although the following descriptions discuss the display pixels as subpixels 82, the systems and methods described herein may be applied to one or more pixels 80 and/or more than one subpixel 82. Moreover, although the following descriptions discuss the bit sequences being 8-bit sequences representing 256 gray levels (e.g., 0 to 255), which represents a particular embodiment, the systems and methods described herein may be applied to any suitable bit depth (e.g., 2-bit sequence representing 4 gray levels, 7-bit sequence representing 128 gray levels, 10-bit sequence representing 1024 gray levels, etc.). In the depicted embodiment, the low-frequency luminance region 122 includes eight subpixels 82 of each color (e.g., eight red subpixels, eight green subpixels, and eight blue subpixels). The block diagram of FIG. 10 describes subpixels 82 of one of these colors. By way of example, each of the subpixels 82 may be associated with a particular gray level from "0" to "255," in which "0" represents no or nearly no luminance and "255" represents the brightest or nearly brightest luminance. As shown, half of the gray levels 152 are "242" while another half are "241." As such, the gray levels 152 of these subpixels 82 may be nearly the same.

In the depicted embodiment, the gray level 152 for a value of 242 includes an 8-bit sequence of 11110010 while the gray level 152 for the value of 241 may include an 8-bit sequence of 11110001. As such, a most significant bit 154 (MSB) until a second least significant bit 156 of the 8-bit sequence may include the same values. As shown, only the second least significant bit 156 and a least significant bit 158 (LSB) vary between the 8-bit sequence of each of the subpixels 82 (e.g., for the gray level 152 for the value of 241 and the value of 242). As previously discussed, the row driver 76 may be toggled with each change in the 8-bit sequence. That is, each interval in which an value of the 8-bit sequence changes, such as from a 1 to a 0 or a 0 to a 1, the corresponding row driver 76 for the particular subpixels 82 may be toggled. Thus, if the subpixels 82 are connected to multiple row drivers 76, then the respective row driver 76 of the multiple row drivers 76 may be toggled when the value of the 8-bit sequence changes for the respective subpixels 82. Although the following descriptions describe toggling one or more row drivers 76 when the value in the 8-bit sequence changes, which represents a particular embodiment, the systems and methods described herein may additionally or alternatively include toggling one or more column drivers 74 when the value changes.

As shown, a first 8-bit sequence 162A for a first subpixel 82 may result in three toggles 160. Since the second, third, and fourth subpixels 82 emit the same gray level 152 of 242, the corresponding second 8-bit sequence 162B through a fourth 8-bit sequence 162D may also result in three toggles 160. The 8-bit sequences 162 may be read sequentially based on pixel (e.g., pixel-by-pixel), such that after the microdriver 78 reads the first 8-bit sequence 162A, then the microdriver 78 reads the second 8-bit sequence 162B, and so forth. As depicted, a fifth 8-bit sequence 162E for a fifth subpixel 82 may be a different sequence than the first through the fourth 8-bit sequences 162A-D since the gray level 152 changes (e.g., to gray level for the value of 251). The fifth 8-bit sequence 162E may result in two toggles 160 since the values in the sequence vary twice. Similarly, the sixth 8-bit sequence 162F through the eighth 8-bit sequence 162H may result in two toggles each. Thus, reading the entire bit sequence for the subpixels 82 pixel-by-pixel may result in a total of twenty toggles 160.

Each toggle 160 may consume power such that the less power is available for other components of the display 18 and/or the electronic device 10. Moreover, each toggle 160 may cause the respective row drivers 76 to send an emission signal. Multiple emission signals sent in a short time frame may result in power consumption and/or electromagnetic interference (EMI). As such, a large number of toggles 160 (e.g., more than one toggle 160 per 8-bit sequence 162) may result in unnecessarily consuming power and/or in interference between data lines driven by the microdriver 78. The interference may cause perceivable artifacts on the display 18 and/or degrade wireless communication through a radio of the device 10. Thus, reducing the number of toggles 160 may reduce interference and/or reduce power consumption from the device 10.

To reduce the number of toggles 160, the bits of the bit sequences 162A-H may be provided to the microdriver 78 in a reordered state. That is, rather than sending the 8-bit sequences 162 pixel-by-pixel (e.g., the first 8-bit sequence 162A for the first subpixel 82, the second 8-bit sequence 162B for the second subpixel 82, and so forth), the bit sequences may be sent according to a bit position within the 8-bit sequence. Specifically, the reordering may include using the most significant bit 154 for each of the 8-bit sequences 162A-H as the first 8-bit sequence 162A. The reordering may continue to include the next most significant bit (e.g., bit 7) for each of the 8-bit sequences 162 until the least significant bit 158. As shown, the reordering may result in zero toggles 160 for first reordered 8-bit sequence 164A representing the most significant bit 154 (MSB) for each of the bit sequences 162. Similarly, the second reordered 8-bit sequence 164B (e.g., bit 7) representing a second most significant bit, a third reordered 8-bit sequence 164C representing a third most significant bit (e.g., bit 6), a fourth reordered 8-bit sequence 164D representing a fourth most significant bit (e.g., bit 5), a fifth reordered 8-bit sequence 164E representing a fifth most significant bit (e.g., bit 4), and a sixth reordered 8-bit sequence 164F representing a sixth most significant bit (e.g., bit 3) for each of the bit sequences 162 may also result in zero toggles 160 since the values do not vary (e.g., remain a binary 1 or remain in a binary 0). A seventh reordered 8-bit sequence 164G representing a seventh most significant bit (e.g., bit 2), may result in two toggles 160 since the bit value changes from 0 to 1 after the sixth reordered 8-bit sequence 164F and then from 1 to 0 within the seventh reordered 8-bit sequence 164G. Moreover, an eighth reordered 8-bit sequence 164H representing the least significant bit (LSB) may result in one toggle 160 since the bit value changes from 0 to 1 within the eighth reordered 8-bit sequence 164H. In this manner, the reordered sequence may result in a total of four toggles 160. That is, the values may only change four times (as indicated by the bold and underlined values) as opposed to twenty times that result with the pixel-by-pixel sequence. Thus, the reordered sequence 164 may allow the device 10 to consume less power and/or experience less interference.

Figure 11:
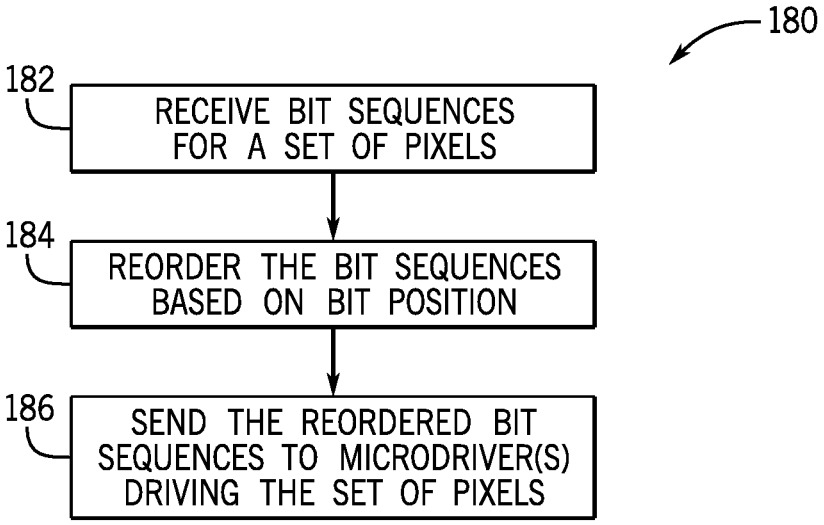
FIG. 11 is a flowchart illustrating a method for driving display pixels using a reordered bit sequence.

FIG. 11 is a flowchart 180 of a method for driving display pixels using a reordered bit sequence. By way of example, the set of display pixels may include the subpixels 82 in the low-frequency luminance region 122 of FIG. 9. Although the following descriptions discuss the display pixels as subpixels 82, the systems and methods described herein may be applied to one or more pixels 80 and/or more than one subpixel 82. Moreover, although the reordering 180 is described as being performed by the support circuitry 62 (including the video TCON 66 and/or emission TCON 72), it should be noted that any suitable device may perform the operations described herein (e.g., processing circuitry such as the processor(s) 12 that may be in communication with the display 18). Additionally, although the reordering of the flowchart 180 is described as being performed in a particular order, it should be noted that the reordering of the flowchart 180 may be performed in other suitable orders.

As illustrated, the support circuitry 62 may receive (process block 182) bit sequences 162 for a set of display pixels for an image to be displayed on the display 18. Specifically, the bit sequences 162 (e.g., n-bit sequences or 8-bit sequences 162 of FIG. 10) may include image data 64 deserialized into pixel data 70 signals to send to the microdrivers 78 to drive the subpixels 82 in the low-frequency luminance region 122, using the techniques described in FIG. 7. That is, the pixel data 70 may represent gray levels 152 in binary format to facilitate displaying the image 120 using the bit sequences 162. Since the set of pixels include subpixels 82 of in the low-frequency luminance region 122, the bit sequences 162 may represent gray levels that do not significantly vary.

Since the second subpixel 82 near one another in the low-frequency luminance region 122 have the same or similar gray values, and thus, their respective bit sequences 162 do not significantly vary, the display panel 60 and/or the device 10 may benefit from reordered bit sequences (e.g., reordered sequences 164 of FIG. 10) based on bit position. As previously mentioned, reordering the bit sequences 162 based on bit position may result in less value variance in the sequence than without reordering. The number of value variances may correspond to a number of toggles of a respective row driver 76 used to drive the set of subpixels 82, and each toggle may be associated with a level of power consumption. As such, reducing the number of toggles may reduce power consumption. Reducing the number of toggles of the respective row driver 76 may also reduce electromagnetic interference within the display panel 60.

Thus, the support circuitry 62 may reorder (process block 184) the bit sequences 162 based bit position. As previously discussed, support circuitry 62 may reorder the bit sequences 162 prior to sending the bit sequences 162 of the pixel data 70 to the microdriver memory 100 and/or as the microdriver memory 100 stores and reads it to the subpixels 82. Reordering may include rearranging bits based on bit position within the bit sequences 162 so that the most significant bit 154 (MSB) position for each of the bit sequences 162 is sent as the first bit sequence. The reordering may continue to send subsequent bit sequences 162 with the next most significant bit for each of the bit sequences 162 as a second bit sequence, until the least significant bit (LSB) 158. Thus, the number of bits or values in the pixel-by-pixel sequence and the reordered sequence may be the same.

After reordering the bit sequences 162, the support circuitry 62 may send (process block 186) the reordered sequences 164 to microdrivers(s) 78 driving the set of display pixels (e.g., subpixels 82). In particular, the microdriver 78 may receive a first reordered bit sequence 164 that includes the most significant bit 154 for each of the subpixels 82, a second reordered bit sequence 164 that includes the second most significant bit for each of the subpixels 82, and so forth. The microdriver 78 may continue to receive each of the reordered bit sequences 164 until it receives the bits for each bit position (e.g., most significant bit 154 to least significant bit 158) for the subpixel 82 of the low-frequency luminance region 122. In some embodiments, the order of the reordered bit sequences 164 may not be sequential (e.g., most significant bit 154 to least significant bit 158 or least significant bit 158 to most significant bit 154). Instead, the order may be set in a manner to provide the fewest toggles 160 possible for the set of display pixels. In some instances, this may occur when a majority values at a bit position within each of the plurality of bit sequences are the same. The bits of the same significance (e.g., most significant bit, second most significant bit, and so forth) of the reordered sequences 164 may be provided over the same data line of multiple data lines driven by the microdriver 78.

In some embodiments, the support circuitry 62 may also include the data reorder indicator 102 in the bit sequences 162, as previously discussed. The data reorder indicator 102 may include the particular bit and/or flag to indicate the manner in which the bit sequences 162 of the pixel data 70 should be stored in the microdriver memory 100 and/or read by pulse width modulation control 104 of the microdriver 78 to the subpixels 82. If the set of sequences 162 include the particular bit or flag, then the microdriver memory 100 may store the pixel data 70 in the reordered format or the support circuitry 62 may reorder the pixel data 70 prior to sending it to the subpixels 82.

Figure 12:
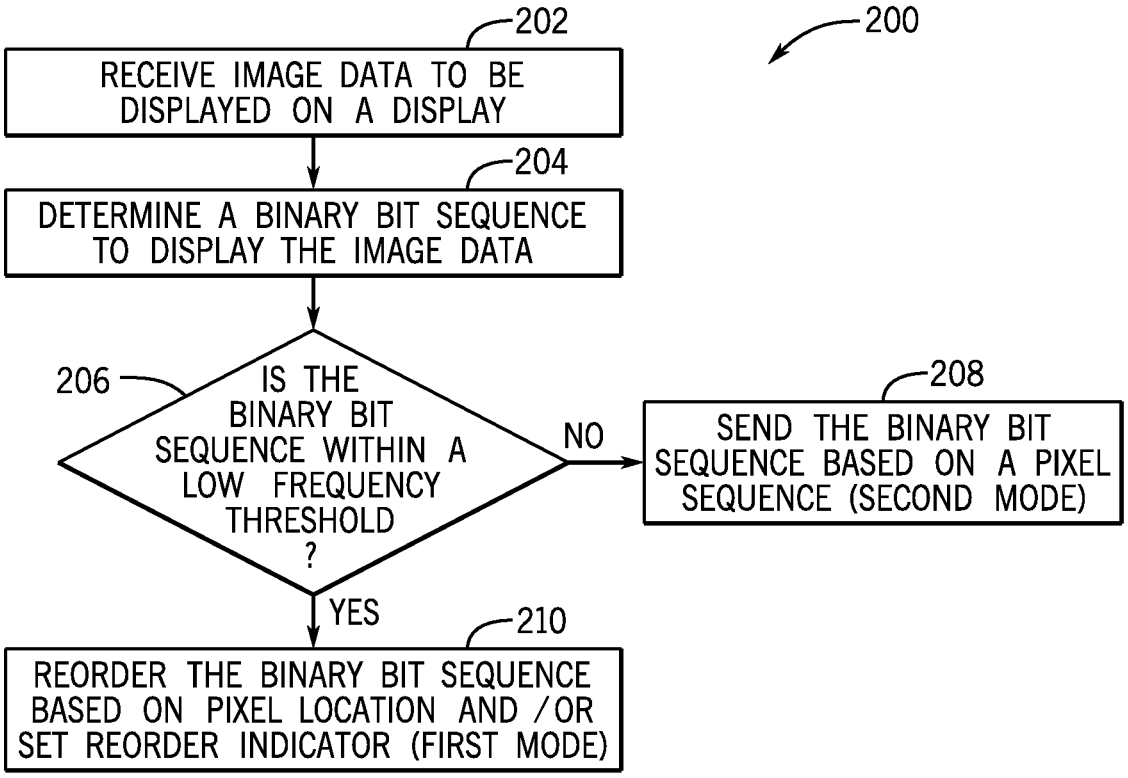
FIG. 12 is a flowchart illustrating a method for reordering the bit sequence corresponding to gray level values associated with the set of display pixels, according to embodiments of the present disclosure.

FIG. 12 is a flowchart 200 of a method for determining reordering the bit sequence corresponding to gray level values associated with a set of display pixels on the region of the display 18 (e.g., display panel 60 of FIG. 7). By way of example, the set of display pixels may include the subpixels 82 in the low-frequency luminance region 122 of FIG. 9. Although the following descriptions discuss the display pixels as subpixels 82, the systems and methods described herein may be applied to one or more pixels 80 and/or more than one subpixel 82. Moreover, although the following descriptions discuss the bit sequences being 8-bit sequences representing 256 gray levels (e.g., 0 to 255), which represents a particular embodiment, the systems and methods described herein may be applied to any suitable bit depth (e.g., 2-bit sequence representing 4 gray levels, 7-bit sequence representing 128 gray levels, 10-bit sequence representing 1024 gray levels, etc.). Although the reordering 200 is described as being performed by the support circuitry 62 (including the video TCON 66 and/or emission TCON 72), it should be noted that any suitable device may perform the operations described herein (e.g., processing circuitry such as the processor(s) 12 that may be in communication with the display 18). Additionally, although the reordering of the flowchart 200 is described as being performed in a particular order, it should be noted that the reordering of the flowchart 200 may be performed in other suitable orders.

As illustrated, the support circuitry 62 may receive (process block 202) image data 64 for an image to be displayed on the display 18. The image data 64 may be deserialized into pixel data 70 signals to send to the microdrivers 78 to drive the subpixels 82, using the techniques described in FIG. 7. The pixel data 70 may represent gray levels 152 to facilitate displaying the image 120. The gray levels 152 may be represented in binary format, such as an 8-bit sequence. Often, the image 120 may include portions that include gray levels of the lowest possible luminance (e.g., 0) and/or the highest possible luminance (e.g., 255), and shades in between. Moreover, a microdriver 78 may drive a set of pixels 80 and/or subpixels 82 that may be associated with one or more portions of the display 18.

By way of example, one of the portions of the image 120 to be displayed may include a region with pixels having a similar brightness (e.g., the low-frequency luminance region 122). As such, these subpixels 82 may emit light to at similar gray levels 152. After receiving the image data 64, the support circuitry 62 may determine (process block 204) the pixel data 70 signals and corresponding bit sequences 162 to display the image data 64 by driving the subpixels 82. That is, based on the gray levels to generate the image 120, the support circuitry 62 may determine corresponding bit sequences 162 for each of the subpixels 82 in the set of display pixels. A bit sequence 162 may include an 8-bit sequence representing the gray level associated with a particular subpixel 82, as discussed in detail with respect to FIG. 10.

The support circuitry 62 may determine (decision block 206) whether the bit sequence 162 is within a low frequency threshold. That is, the support circuitry 62 may determine whether the microdriver 78 may send the bit sequences 162 for the respective subpixels 82 in a location based column-by-column (e.g., first mode) or a pixel-by-pixel (e.g., a second mode) manner. As previously discussed, low frequency may refer to the bit sequences 162 for each of the subpixels 82 (e.g., the 8-bit sequence 162 of a first subpixel 82, a second subpixel 82, a third subpixel 82, and so forth of FIG. 10) in the region to not significantly vary. As a result, the most significant bits of the bit sequences 162 for each of the subpixels 82 may be the same. On the other hand, high frequency may refer to the bit sequences 162 of the pixel data 70 to significantly vary, such that the most significant bits of the bit sequences are not the same or approximately the same. The threshold may be predefined and based on image content variance.

In particular, the image content variance may be associated with a number of resulting toggles, as previously discussed with respect to FIG. 10. Thus, the low frequency threshold may be set based on a number of toggles resulting from reordering the bit sequence 162 to be less than the number of toggles for a default pixel-by-pixel sequence. Additionally or alternatively, the low frequency threshold may be based on a predetermined power consumption level (e.g., a maximum power consumption for the display 18) and/or a maximum tolerance for electromagnetic interference.

If the bit sequence 162 is not within the low frequency threshold, then the support circuitry 62 may send (process block 208) the bit sequences 162 based on the pixel sequence. By way of example, the support circuitry 62 may first send the 8-bit sequence 162 for the first subpixel 82, the 8-bit sequence 162 for the second subpixel 82, and so forth. As previously discussed, the support circuitry 62 may toggle the respective row driver for the subpixel 82 when an value in each of these bit sequences 162 change. However, the value may not vary for the first few significant bits since the gray values are similar within the set of subpixels 82.

On the other hand, the support circuitry 62 may reorder (process block 210) each of the bit sequences 162 based on pixel location on the display or bit positon within the bit sequences 162 and/or set the reorder indicator 102 if the bit sequence 162 is within the low frequency threshold. As previously discussed, support circuitry 62 may reorder the bit sequences 162 prior to sending the bit sequences 162 of the pixel data 70 to the microdriver memory 100 and/or as the microdriver memory 100 stores and reads it to the subpixels 82. By way of example, reordering may include rearranging bits so that the most significant bit 154 for each of the 8-bit sequences 162 is sent as the first 8-bit sequence 162A. The reordering may continue to send subsequent 8-bit sequences 162 with the next most significant bit (e.g., bit 7) for each of the 8-bit sequences 162 as a second 8-bit sequence 162B, until the least significant bit 158 (e.g., eighth 8-bit sequence 162H). Thus, the number of bits or values in the pixel-by-pixel sequence and the reordered sequence may be the same. Additionally or alternatively, the support circuitry 62 may send a predefined number of bits (e.g., two 8-bit sequences corresponding to two subpixels 82) when sending the pixel data 70 to the microdriver 78. The support circuitry 62 may determine using the pixel-by-pixel mode and/or the reorder mode based on the value variance of the predefined number of bits. Furthermore, the support circuitry 62 may communicate the determined mode to the microdriver 78 to facilitate in its reading of the pixel data 70 for the subpixels 82.

As previously discussed, in some embodiments, the support circuitry 62 may include the data reorder indicator 102 in the bit sequences 162. The data reorder indicator 102 may include the particular bit and/or flag to indicate the manner in which the bit sequences 162 of the pixel data 70 should be stored in the microdriver memory 100 and/or read by pulse width modulation control 104 of the microdriver 78 to the subpixels 82. If the set of sequences 162 include the particular bit or flag, then the microdriver memory 100 may store the pixel data 70 in the reordered format or the support circuitry 62 may reorder the pixel data 70 prior to sending it to the subpixels 82. As previously discussed, the reordered sequences 164 of the 8-bit sequences 162 may reduce power consumption and/or electromagnetic interference that may otherwise cause perceivable image artifacts on the display 18 and/or degraded wireless communications between the electronic device 10 and other devices.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A display device comprising:

a timing controller configured to:

receive a plurality of bit sequences of image data for a plurality of pixels of the display device, wherein each of the plurality of bit sequences correspond to a respective individual pixel of the plurality of pixels; and reorder the plurality of bit sequences into a reordered plurality of bit sequences in which bits of a same significance corresponding to different pixels of the plurality of pixels are grouped together; and a microdriver configured to:

receive the reordered plurality of bit sequences; and drive the plurality of pixels using the reordered plurality of bit sequences.

2. The display device of claim 1, wherein the plurality of pixels emit a same or approximately a same gray value.

3. The display device of claim 1, wherein at least a most significant bit position within each of the plurality of bit sequences has a same value.

4. The display device of claim 1, wherein reordering the plurality of bit sequences into the reordered plurality of bit sequences comprises generating an order of most significant bits to least significant bits.

5. The display device of claim 1, wherein the microdriver is configured to toggle a row driver of the display device a fewer number of instances when driving the plurality of pixels with the reordered plurality of bit sequences than without reordering, wherein toggling occurs in response to a value change within a bit sequence when the microdriver drives a particular pixel of the plurality of pixels.

6. The display device of claim 1, wherein the reordered plurality of bit sequences comprise a reorder indicator prior to storing the reordered plurality of bit sequences in memory of the microdriver.

7. The display device of claim 1, wherein the microdriver drives the plurality of the pixels using a data line, wherein the plurality of pixels comprise a plurality of subpixels, and wherein the data line drives four or more subpixels of the plurality of subpixels.

8. The display device of claim 1, wherein each of the plurality of bit sequences and each of the reordered plurality of bit sequences comprise a same number of bits.

9. The display device of claim 1, wherein the timing controller is configured to:

determine whether values in a significant bit position of each of the plurality of bit sequences are within a variance frequency threshold, wherein the variance frequency threshold is based on a number of toggles associated with a respective bit sequence; and in response to the values in the significant bit position of each of the plurality of bit sequences being within the variance frequency threshold, reorder the plurality of bit sequences to the reordered plurality of bit sequences.

10. The display device of claim 9, wherein the values in the significant bit position of each of the plurality of bit sequences are within the variance frequency threshold in response to the plurality of pixels emitting at a same or approximately a same gray level to display an image.

11. The display device of claim 10, wherein the same or approximately the same gray level is based on the plurality of bit sequences for the plurality of pixels having a same value for at least a most significant bit of the plurality of bit sequences.

12. The display device of claim 1, wherein the microdriver is configured to:

determine the plurality of bit sequences as the reordered plurality of bit sequences based on a reorder indicator bit received in a bit stream, wherein the bit stream comprises the reordered plurality of bit sequences.

13. A tangible, non-transitory, machine-readable medium, comprising machine-readable instructions that, when executed by one or more processors, cause the one or more processors to:

receive bit sequences of image data to be displayed by a corresponding plurality of pixels of a display device;

reorder the bit sequences into reordered bit sequences in which bits of a same significance corresponding to different pixels of the plurality of pixels are grouped together; and send the reordered bit sequences to a microdriver to drive the plurality of pixels.

14. The tangible, non-transitory, machine-readable medium of claim 13, wherein each of the bit sequences represents a gray level provided in a per-pixel bit order before reordering.

15. The tangible, non-transitory, machine-readable medium of claim 13, comprising machine-readable instructions that, when executed by one or more processors, cause the one or more processors to:

determine whether a value variance within each of the bit sequences is within a frequency threshold range;

in response to the bit sequences being within the frequency threshold range, reorder the bit sequences to the reordered bit sequences based on a bit position; and in response to the bit sequences being greater than or less than the frequency threshold range, maintain order of the bit sequences.

16. An electronic device comprising:

a processor configured to process image data; and data driving circuitry configured to:

receive, over a plurality of data lines, a plurality of bit sequences corresponding to a plurality of gray values of the image data to be displayed by a plurality of pixels of the electronic device, wherein bits of the plurality of bit sequences are grouped by bit significance in which bits of a same bit significance are received over a same data line of the plurality of data lines; and drive the plurality of pixels using the plurality of bit sequences.

17. The electronic device of claim 16, wherein each pixel of the plurality of pixels comprises a micro-LED.

18. The electronic device of claim 16, wherein the electronic device comprises a microdriver to drive the plurality of pixels using the plurality of bit sequences.

19. The electronic device of claim 18, wherein the data driving circuitry is configured to drive the plurality of pixels using the plurality of bit sequences at least in part by sending the plurality of bit sequences to the microdriver over the plurality of data lines.

20. The electronic device of claim 16, wherein most of the plurality of gray values represented by the plurality of bit sequences are a same gray value.

21. The electronic device of claim 16, wherein the plurality of pixels driven using the plurality of bit sequences are in a same row of pixels.

22. The electronic device of claim 16, wherein the plurality of pixels driven using the plurality of bit sequences are in a same column of pixels.

23. The electronic device of claim 16, wherein the plurality of pixels driven using the plurality of bit sequences are in at least two rows and at least two columns.

* * * * *